United States Patent [19]

Sutton

[11] 4,088,259

[45] May 9, 1978

[54] DIE-DRIED MOLDED PULP EGG CARTON

[75] Inventor: John T. Sutton, Belgrade, Me.

[73] Assignee: Keyes Fibre Company, Waterville, Me.

[21] Appl. No.: 849,550

[22] Filed: Nov. 8, 1977

[51] Int. Cl.[2] ..... B65D 1/24

[52] U.S. Cl. ..... 229/2.5 EC; 229/29 M; 162/392

[58] Field of Search ..... 229/2.5 EC, 29 M; 162/392, 329; 249/175

[56] References Cited

U.S. PATENT DOCUMENTS

| | | | |
|---|---|---|---|
| 2,183,869 | 12/1939 | Randall et al. | 162/392 X |
| 2,273,055 | 2/1942 | Manson | 249/175 |
| 2,423,756 | 7/1947 | Chaplin | 229/2.5 EC |
| 2,560,847 | 7/1951 | Chaplin | 229/2.5 EC |
| 2,600,130 | 6/1952 | Schilling | 229/2.5 EC |
| 2,704,493 | 3/1955 | Randall | 229/15 |
| 2,885,136 | 5/1959 | Grant | 229/2.5 EC |
| 3,016,176 | 1/1962 | Reifers et al. | 229/2.5 EC |
| 3,185,370 | 5/1965 | Reifers et al. | 229/2.5 EC |
| 3,207,409 | 9/1965 | Reifers et al. | 229/2.5 EC |
| 3,360,150 | 12/1967 | Schechter | 229/2.5 EC |
| 3,398,875 | 8/1968 | Snow et al. | 229/2.5 EC |
| 3,613,987 | 10/1971 | Laidman | 229/2.5 EC |

*Primary Examiner*—Davis T. Moorhead
*Attorney, Agent, or Firm*—Connolly and Hutz

[57] ABSTRACT

A molded pulp egg carton of the type having a pocketed bottom with a closeable cover integrally hinged to it wherein the cover has compact thickness, rigid firmness and densified hardness qualities obtained by being simultaneously dried and finish-formed between mating heated pressing molds, and the bottom has egg cushioning ribbons which have non-compacted consistency, resilient softness and an irregular fibrous feel and appearance obtained by being dried in a free space, defined by slots in a drying and pressing mold, without finish-forming pressure.

10 Claims, 7 Drawing Figures

DIE-DRIED MOLDED PULP EGG CARTON

BACKGROUND OF THE INVENTION

This invention relates to the field of contoured cartons molded to essentially finished shape by the suction deposition of fibrous pulp materials from an aqueous slurry thereof against screen-covered, open-face forming molds, followed by subsequent drying, and known as molded pulp cartons. A tremendous number of different styles of molded pulp cartons have been proposed for packaging a wide range of commodities, but this invention is particularly concerned with cartons designed for the retail merchandizing of fragile articles such as eggs, light bulbs, electron tubes, Christmas tree ornaments, and the like. Companion but mutually inconsistent requirements for such cartons are good cushioning qualities for the fragile articles, and good printability qualities for retail merchandizing purposes.

Cartons molded of fibrous pulp material are particularly suitable for packaging fragile articles, because molded pulp has non-compacted consistency, resilient softness, and an irregular fibrous feel and appearance which imparts desirable cushioning characteristics to the carton. Many different styles of such molded pulp cartons for fragile articles such as eggs have been proposed, many of which have narrow ribs arranged in generally vertically radial array within one or more of the egg pockets, for various purposes. Representative thereof are the egg cartons disclosed in patents such as: Chaplin U.S. Pat. No. 2,423,756 issued July 1947; Chaplin U.S. Pat. No. 2,560,847 issued July 1951; Schilling U.S. Pat. No. 2,600,130 issued June 1952; Grant U.S. Pat. No. 2,885,136 issued May 1959; Reifers U.S. Pat. No. 3,016,176 issued January 1962; Reifers U.S. Pat. No. 3,145,896 issued August 1964; Reifers U.S. Pat. No. 3,185,370 issued May 1965; Reifers U.S. Pat. No. 3,207,409 issued September 1965; and, Snow U.S. Pat. No. 3,398,875 issued August 1968. None of these types of disclosures, however, suggest the concept of an egg carton having the cover printability advantages attained by the carton of the present invention.

One problem common to egg cartons, such as those disclosed in the aforesaid patents wherein the closeable cover is integrally hinged to the pocketed bottom, is that the cover, and particularly the outer surface thereof, has the non-compacted consistency, resilient softness, and irregular fibrous feel and appearance present in the inner surface of the egg pockets. The reason for this, of course, is that the closeable cover, being integrally hinged to the pocketed bottom, is formed on the same molding apparatus by the same method as the pocketed bottom. The inevitable result is that the outer surface of the cover is not well adapted to receive printing for the important purpose of including advertising and other information on the visible outer surface of the closed cover, because it is well known that the rough, cushiony surface of molded pulp does not lend itself to the reception of printed matter, particularly high resolution printing including small letters and other details.

This problem has been recognized for a long time, and one approach to avoiding it is to pre-print separate labels on paper capable of receiving high resolution printing, and then glue the labels to the covers of the molded pulp cartons — an expensive and cumbersome procedure at best.

Another approach to solving it is disclosed in Randall U.S. Pat. No. 2,704,493 issued March 1955 wherein the egg carton is molded on conventional apparatus according to the conventional method wherein the carton is first formed against an open-face suction mold, and then dried in a free space such as being placed on a conveyor and moved through a heated drying oven, but then the finished, dried carton is subjected to an "after-pressing" operation wherein the dried cartons are pressed in the presence of heat and moisture between a pair of mating molds only to the extent sufficient to remove warpage and distortion and provide an improved surface finish while retaining the cushioning characteristics obtained by the free drying. While this improves the printing capabilities over cartons which are simply free dried without after-pressing, the smoothly ironed surface of the cover nevertheless inherently retains some of the cushioning characteristics obtained by the initial free drying which tends to defeat optimum printing requirements, and the after-pressing inherently removes some of the rough fibrous cushioning attributes from the inner surface of the egg pockets which tends to defeat optimum egg protecting requirements. The aforesaid Randall patent thus discloses a useful compromise between "free-dried" or "open-dried" rough finished articles, on the one hand, and "die-dried" or "closed-dried" molded pulp articles on the other hand, both of which are explained therein.

The terms "free-dried" or "open-dried" as used herein include not only the use of flat conveyors for moving the cartons through the drying oven, but also the use of open-face warpage-preventing forms on the conveyor for holding the cartons as they are moved through the drying oven. Such warpage-preventing forms are known from disclosures such as the aforesaid Reifers U.S. Pat. No. 3,185,370, and are to be contrasted with "die-drying" or "closed-drying" processes.

The "die-dried" or "close-dried" molded pulp articles are quite different, and are made for instance by apparatus and according to a method such as that described in Randall U.S. Pat. No. 2,183,869 issued December 1939. These articles are dense, hard, boardy, and inferior in cushioning and resilient qualities, but extremely smooth-finished for the reception of even very high resolution printing. Such die-dried molded pulp articles have been made and sold in the form of disposable plates, bowls and the like under the trademark "CHINET" for many years by Keyes Fibre Company of Maine, U.S.A.

Egg cartons heretofore have not been made by "die-dried" or "closed-dried" processes, however, not only because it is a more expensive procedure, but because the inner surface of the egg pockets would be hard and board-like and would not have the non-compacted consistency, resilient softness and irregular fibrous feel and appearance required for acceptable egg holding and protecting purposes.

Thus, the problem heretofore unresolved by the prior art is the ability to produce a one-piece molded pulp egg carton wherein the inside of the egg pockets have the resilient softness desirable for proper egg holding and protecting capabilities, and the outside of the cover has a smooth feel and appearance desirable for aesthetic characteristics including the ability to receive high resolution printing.

SUMMARY OF THE INVENTION

The present invention provides a one-piece egg carton molded of fibrous pulp material and dried between mating heated finishing molds which impart to the cover compact thickness, rigid firmness and densified hardness qualities, and the portion of the mold which finishes the inside of the egg pockets is provided with slots to form egg cushioning ribbons which have non-compacted consistency, resilient softness and an irregular fibrous feel and appearance obtained by being dried in the free space provided by the slots without any finish-forming pressure.

BRIEF DESCRIPTION OF THE DRAWINGS

Numerous advantages of the present invention will become apparent to one skilled in the art from a reading of the detailed description in conjunction with the accompanying drawings wherein similar reference characters refer to similar parts, and in which.

DETAILED DESCRIPTION OF THE INVENTION

Figure 1:
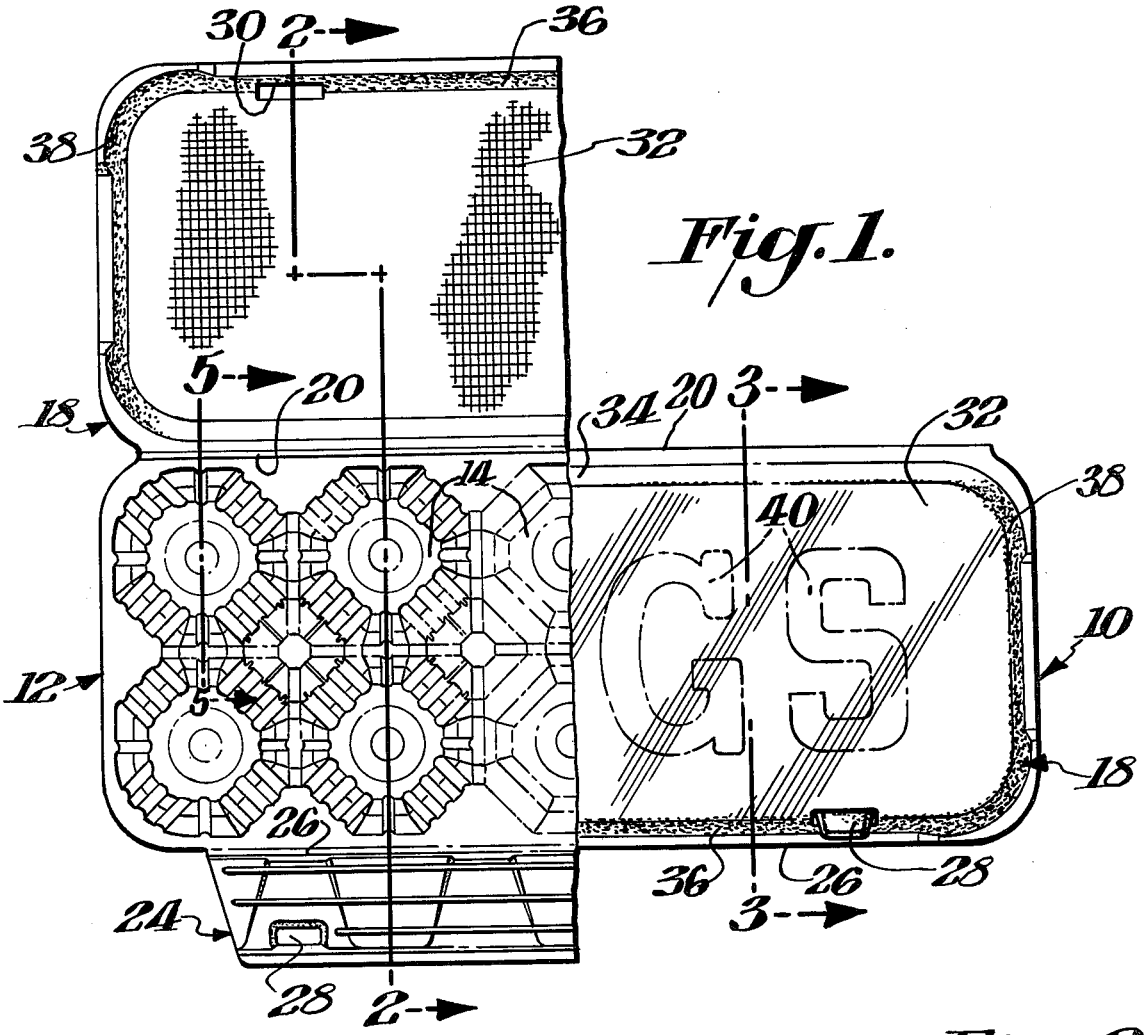
FIG. 1 is a composite plan view of the die-dried one-piece molded pulp egg carton according to this invention, the left-hand portion showing the carton in the open position and the right-hand portion showing the carton in the closed position.

The principles of this invention are beneficial in connection with any carton for packaging fragile articles which is molded in one piece of fibrous pulp material having a pocketed bottom and a closeable cover integrally hinged thereto for folding between a closed and an open position. A representative carton 10 illustrated in the drawings comprises a pocketed bottom 12 formed to provide a plurality of downwardly dished egg pockets 14. The egg pockets 14 have a vertical depth at least as great as one-half the length of an egg 16 of the size which the carton is dimensioned to accommodate, to hold and protect the eggs packaged therein.

Figure 2:
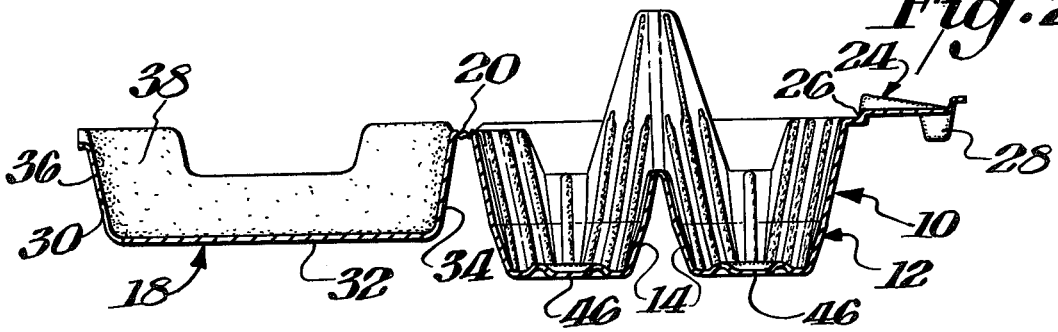
FIG. 2 is a transverse sectional elevational view on line 2—2 of FIG. 1 showing the carton in the open position.
Figure 3:
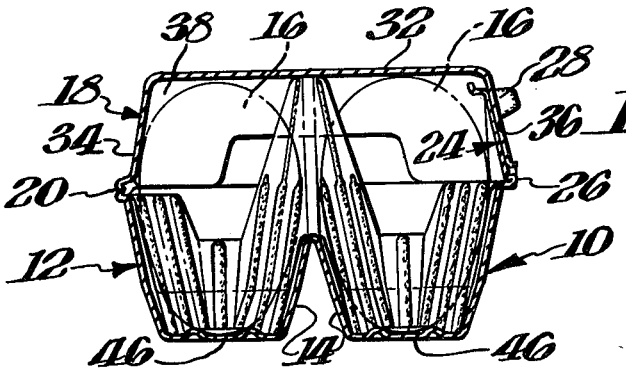
FIG. 3 is a transverse sectional elevational view on line 3—3 of FIG. 1 showing the carton in the closed position.
Figure 4:
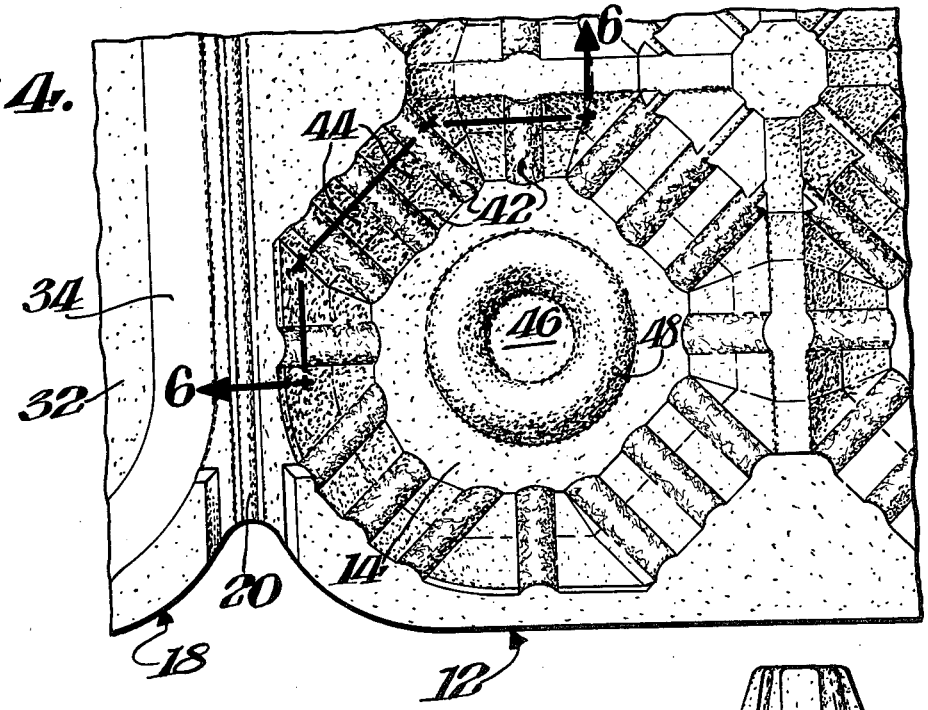
FIG. 4 is an enlarged partial plan view looking down into a corner egg pocket, with a fragment of the hinged cover shown in the open position.
Figure 5:
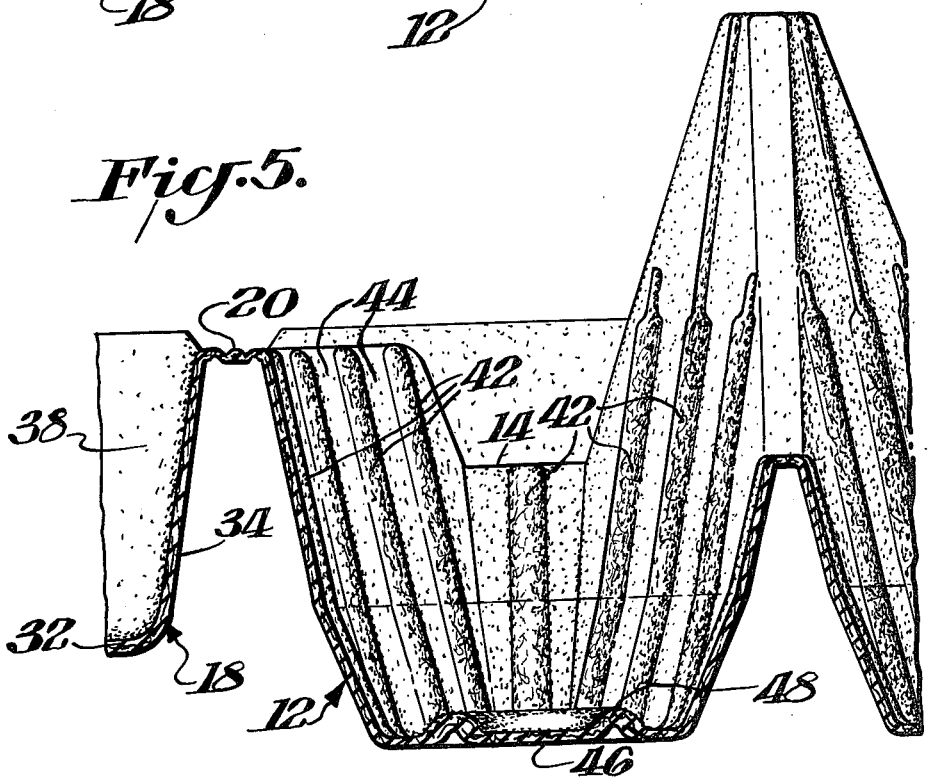
FIG. 5 is an enlarged partial sectional elevational view on line 5—5 of FIG. 1.

The carton 10 also has a closeable cover 18 integrally hinged as at 20 to the pocketed bottom 12 for folding between a closed position overlying the egg pockets 14 (FIG. 3), and an open position (FIG. 2) which permits a like empty carton to be nested therein in a stack 22 of such cartons.

Optional features of the carton include a locking flap 24 integrally hinged as at 26 to the pocketed bottom 12 for folding between a closed position for locking cooperation with the closed cover 18 (FIG. 3) and an open position (FIG. 2) which permits a like empty carton to be nested therein in a stack 22 of such cartons. In the embodiment illustrated, the locking flap 24 includes a pair of locking buttons 28 for latching cooperation with a pair of locking apertures 30 in the cover 18, all as is well-known.

The pocketed bottom 12 is formed to provide a plurality of egg pockets 14 arranged in two parallel rows, namely 10 such pockets in two rows of five pockets each, and the cover 18 in the closed position overlies both rows of egg pockets. Other arrangements obviously are included within the scope of this invention, however, such as cartons having 12 egg pockets arranged either in two rows of six pockets each or in three rows of four pockets each. With any such arrangement of pockets, of course, the principles of this invention are also applicable to cartons having two closeable covers, one integrally hinged to each side of the carton, for folding between open positions and closed positions wherein each such cover overlies certain of the egg pockets.

The closeable cover 18 in the illustrated embodiment includes a flat planar base 32, and surrounding side walls depending therefrom such as a rear side wall 34, a front side wall 36, and opposed end side walls 38, the side walls having a vertical depth no greater than one-half the length of an egg 16 of the size which the carton is dimensioned to accommodate. Other egg carton designs also will benefit from this invention, such as egg cartons wherein the downwardly dished pockets have a vertical depth which is as great as the length of an egg of the size which the carton is dimensioned to accommodate, and the closeable cover integrally hinged thereto has little if any surrounding side walls depending from the flat planar base. In any event, the outer surface of the closeable cover of the carton according to this invention may have advertising or other indicia 40 printed directly thereon and, as explained more fully below, the printing may be of exceptionally high resolution.

A central feature of the present invention involves the qualities or characteristics of the outer surface of the closeable cover 18, and the inner surface of the pocketed bottom 12. The closeable cover has compact thickness, rigid firmness, densified hardness and detectable surface qualities obtained by being simultaneously dried and finish-formed between mating heated pressing molds. The outer surface of the closeable cover, and particularly the flat planar base 32 thereof, has a smooth feel and appearance as produced by being finish-formed with a smoothly polished, heated metal pressing surface. The inner surface of the closeable cover has a finely textured embossed feel and appearance as produced by being finish-formed with a pressing surface defined by a fine-mesh heated screen.

The pocketed bottom 12, in contrast to the closeable cover, has egg holding and protecting qualities comparable to such qualities as are obtained with molded pulp which is first suction molded and then "open dried" in an oven. The inner surface of the pocketed bottom has egg holding and protecting portions 42 protruding from thinner supporting side wall portions 44. The thinner side wall portions 44 have compact thickness, rigid firmness, and densified hardness qualities obtained by being simultaneously dried and finish-formed between mating heated pressing molds. The egg holding and protecting portions 42 of the inner surface of the egg pockets, on the other hand, have non-compacted consistency, resilient softness, and an irregular fibrous feel and appearance as produced by being dried in a free space without finish-forming pressure. The outer surface of the pocketed bottom 12 has a generally smooth feel and appearance as produced by being finish-formed with a smoothly polished, heated metal pressing surface, just as the outer surface of the closeable cover described above. Similarly, the outer surface of the locking flap 24 has a generally smooth feel and appearance as produced by being finish-formed with a smoothly polished, heated metal pressing surface.

The inwardly protruding egg holding and protecting portions 42 are formed and arranged to provide cushioning areas within each egg pocket 14 to support an egg 16 of the size which the carton 10 is dimensioned to accommodate. In the embodiment illustrated, the egg holding and protecting portions 42 take the shape of elongated cushioning ribbons arranged in generally vertically radial array within each egg pocket. The cushioning ribbons, as explained in greater detail below, are produced by generally vertically radial slots providing free spaces in a drying and pressing mold. In the illustrated embodiment, the egg pockets 14 have effectively horizontal bottoms 46, and the egg holding and protecting portions may further include circular cushioning ribbons 48 protruding upwardly from the bottom 46 of each pocket. The circular cushioning ribbons 48 also are produced by circular slots providing free spaces in a drying and pressing mold.

While not necessarily a critical feature of the present invention, the cushioning ribbons in the carton illustrated have a width of at least about ⅛ inch, and protrude from the thinner wall portions at least about 1/32 inch at their thickest part, which is usually along the center of the cushioning ribbons. It has been found expedient to design the carton so that the cushioning ribbons occupy less than 50% of the inner surface area of the pocketed bottom, since this insures proper moisture extraction for drying the carton between mating heated pressing molds while simultaneously allowing adequate cushioning ribbon area to properly hold and protect an egg in each egg pocket.

Figure 7:
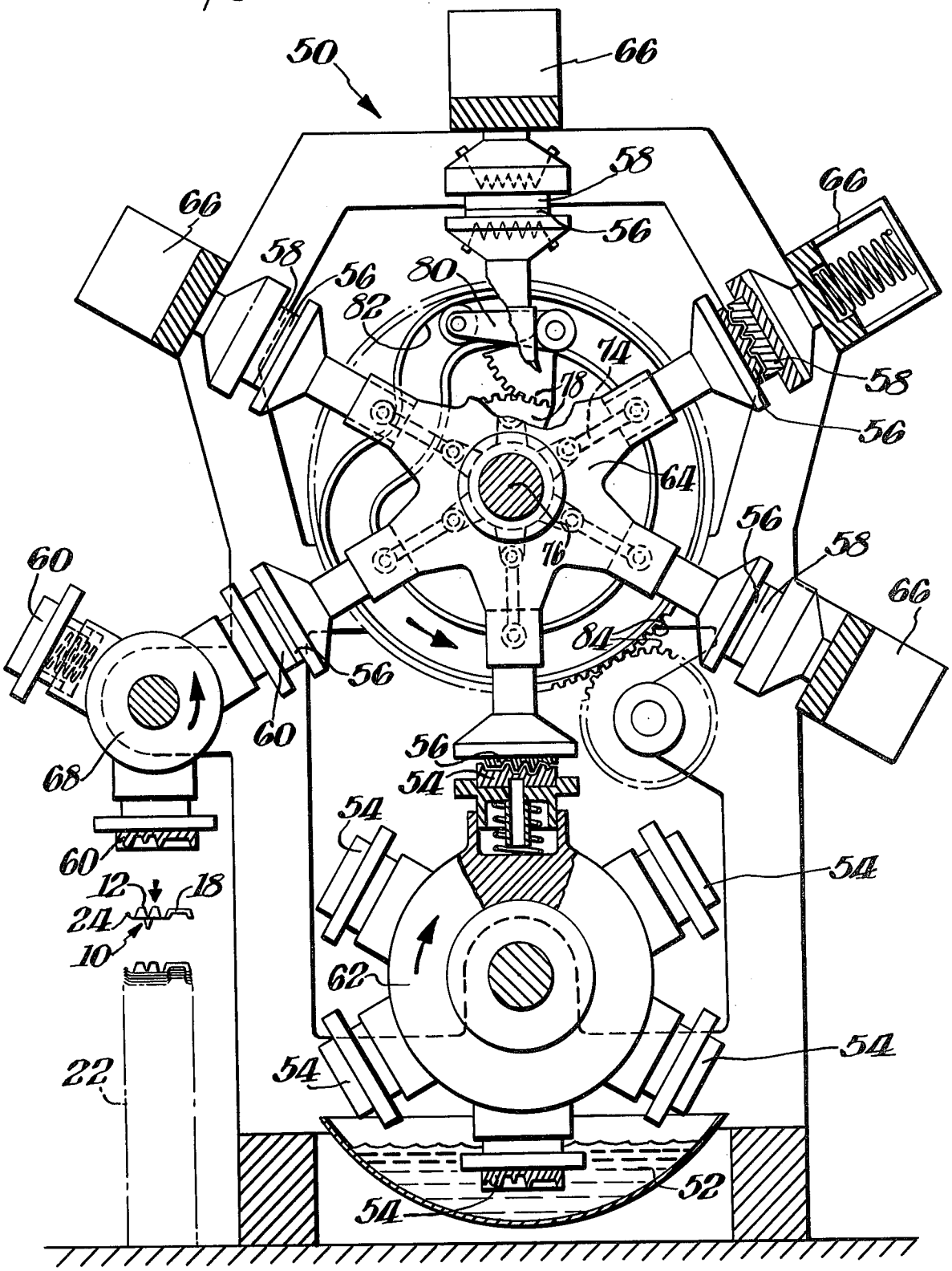

Apparatus for performing the method of molding an egg carton of the type described above is illustrated in stylized fashion in FIG. 7. Such apparatus 50 comprises, in essence, a supply 52 of an aqueous slurry of fibrous pulp material, a foraminous vacuum forming mold 54, a heated vacuum drying mold 56 of unique construction, a heated solid metal finishing mold 58, and a vacuum transfer mold 60.

The basic features of the apparatus 50 are described in informative detail in the aforesaid Randall U.S. Pat. No. 2,183,869, and consist essentially of a first intermittently rotating unit 62 on which six of the foraminous vacuum forming molds 54 may be mounted, a second intermittently rotating unit 64 on which six of the heated vacuum drying molds 56 may be mounted, four circumferentially spaced drying and finish-forming stations 66 each having a spring-loaded heated solid metal finishing mold 58, and a third intermittently rotating unit 68 on which three of the vacuum transfer molds 60 may be mounted. The three rotating units 62, 64 and 68 are driven by well-known means, not shown, in step-wise fashion, the unit 62 being driven clockwise in FIG. 7, the unit 64 being driven counter-clockwise, and the unit 68 also being driven counter-clockwise.

The vacuum drying molds 56 on the intermittently rotating unit 64 are each mounted for radially inward and outward motion, controlled by well-known linkage arrangements 74 operated by a shaft 76 which is oscillated to and fro during each cycle of the machine by segment gearing 78 responsive to a cam following arm 80 controlled by a cam 82 continuously rotated by a standard bull and drive gear arrangement 84. The radially inward and outward movement of the drying molds 56 is such that they are retracted inwardly for the intermittent rotation portion of each machine cycle, and extended in a mechanically compulsive fashion during each operating portion of the machine cycle into contact with the forming molds 54 which are under light spring pressure on the rotating unit 62, the solid metal finishing molds 58 which are under heavy spring load at each station 66, and the vacuum transfer molds 60 which are again under a light spring load on the rotating unit 68.

Following the process of making a molded pulp egg carton, each foraminous forming mold 54 is rotated sequentially into the source 52 of aqueous pulp solution. The molds 54 preferably are screen covered after the well-known fashion, although laminated forming molds such as disclosed in Manson U.S. Pat. No. 2,273,055 issued February 1942 optionally may be employed. Suction is applied in the well-known fashion to deposit from the slurry a layer of wet pulp on the open-face mold 54.

Each forming mold 54 is then rotated in clockwise fashion by the unit 62 out of the slurry 52 through two machine cycles during which the suction applied through the molds 54 continues to extract water from the layers of pulp on the molds. The next cycle of the machine locates the layer of pulp on the mold 54 at a station where it is transferred to one of the vacuum drying molds 56, upon which the layer of pulp will be carried through several subsequent drying and finish-forming stations 66.

The vacuum drying molds 56 are heated molds, being heated to a temperature which will evaporate moisture in the form of steam without scorching the carton being dried. Suction is applied to the molds 56 to remove moisture from the layer of pulp deposited thereon continuously during the subsequent drying and finish-forming operations.

Figure 6:
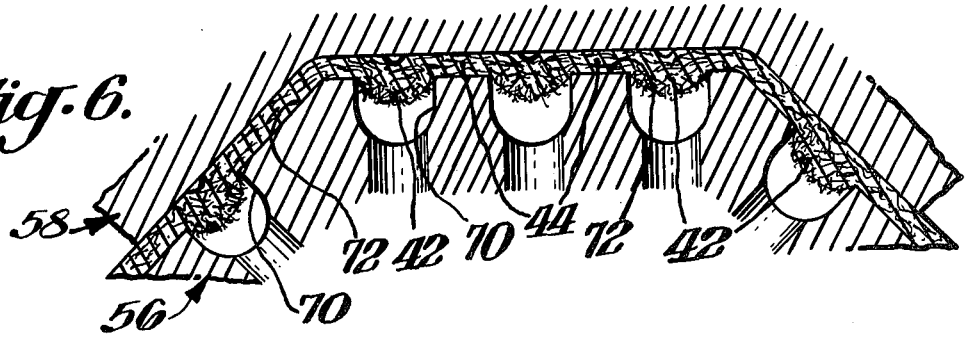
FIG. 6 is a greatly enlarged fragmentary sectional plan view of the side of an egg pocket showing the cushioning ribbons in cross-section; and, FIG. 7 is a stylized representation of apparatus for performing the method of molding an egg carton according to this invention.

The molds 56 are unique in that the portions of them which form the cover of the egg carton, namely the inner surface thereof, are covered with a fine-mesh screen after the well-known fashion, whereas the portions of them which form the pocketed bottom of the egg carton, namely the inner surface thereof, are provided with a series of slots 70, best seen in FIG. 6. The slots 70 permit the cushioning ribbons 42 described above to be formed by being dried in a free space without finish-forming pressure, so that they have non-compacted consistency, resilient softness, and an irregular fibrous feel and appearance. The lands 72 of the molds 56 between the slots 70 form the major area of the inner surface of the pocketed bottom of the carton, and impart to such inner side wall portions between the cushioning ribbons compact thickness, rigid firmness, and densified hardness. The formation of the cushioning ribbons on the inner surface of the carton may create small corresponding indented valleys on the outer surface.

Each vacuum drying mold 56, after it receives from the forming mold 54 the layer of damp molded pulp, is then moved step-by-step in counter-clockwise fashion to the four drying and finish-forming stations 66. The finishing mold 58 at each station 66 is a solid metal mold having a smoothly polished pressing surface, which forms the outer surface of the closeable cover, the pocketed bottom and the locking flap of the carton. Each mold 58 is biased against the layer of pulp on the radially extended vacuum drying molds 56 with a heavy mechanical spring force sufficient to create a compacting action on the layer of pulp to expedite driving the moisture out of it.

In addition to providing pressing force, the finishing molds 58 are heated for the purpose of promoting the drying process, and preferably may be at least as hot as the vacuum drying molds without scorching the carton being dried.

By the time each vacuum drying mold 56 has carried its carton in process of manufacture through the four drying and finish-forming stations 66, the finished carton is then transferred to one of the vacuum transfer molds 60 on the intermittently rotating unit 68. The molds 60 are simple, unheated open-face suction molds which merely remove the finished carton from the vacuum drying molds 56, and rotate the finished cartons to a station at which the cartons are ejected vertically downwardly from each mold 60 by a conventional blast of air pressure. The cartons fall into a nested stack 22 thereof for subsequent packaging and shipment to locations at which the cartons are removed one at a time from the stack, printed, filled with eggs, closed, and thence distributed to retail outlets for sale.

While the foregoing apparatus and method have been described in abbreviated fashion because the basic features thereof are well-known, the portion of the same which is uniquely suited to the production of an egg carton according to this invention is the provision of the slots 70 in the portion of the vacuum drying molds 56 which form the inner surface of at least the bottom 12 of the egg carton 10. These slots permit the cushioning ribbons to be dried in a free space without finish-forming pressure, so that they have non-compacted consistency, resilient softness, and an irregular fibrous feel and appearance, but the slots 70 are sufficiently narrow, occupying less than 50% of the inner surface of the pocketed bottom of the carton, that the lands 72 between the slots provide the requisite heating and pressing capabilities to dry and finish-form the carton on apparatus and according to the method described above in connection with FIG. 7.

There has thus been disclosed a molded pulp egg carton of the type having a pocketed bottom with a closeable cover integrally hinged to it wherein the cover has compact thickness, rigid firmness and densified hardness qualities obtained by being simultaneously dried and finish-formed between mating heated pressing molds, and the bottom has egg cushioning ribbons which have non-compacted consistency, resilient softness and an irregular fibrous feel and appearance obtained by being dried in a free space, defined by slots in a drying and pressing mold, without finish-forming pressure.

While the above described embodiment constitutes the preferred mode of practicing this invention, other embodiments and equivalents may be resorted to within the scope of the actual invention, which is claimed as:

1. An egg carton molded of fibrous pulp material having a pocketed bottom formed to provide a plurality of downwardly dished egg pockets with a vertical depth at least as great as one-half the length of an egg of the size which the carton is dimensioned to accommodate, and a closeable cover integrally hinged to the pocketed bottom for folding between a closed position overlying the egg pockets and an open position which permits a like empty carton to be nested therein in a stack of such cartons, the improvement being characterized in that the closeable cover has compact thickness, rigid firmness, densified hardness and detectable surface qualities obtained by being simultaneously dried and finish-formed between mating heated pressing molds, the outer surface of the closeable cover having a smooth feel and appearance as produced by being finish-formed with a smoothly polished, heated metal pressing surface, and in that the pocketed bottom has egg holding and protecting qualities comparable to such qualities as are obtained with molded pulp which is first suction molded and then oven dried, the inner surface of the pocketed bottom having egg holding and protecting portions protruding from thinner supporting side wall portions, the thinner side wall portions of the inner surface having compact thickness, rigid firmness, and densified hardness qualities obtained by being simultaneously dried and finish-formed between mating heated pressing molds but the egg holding and protecting portions of the inner surface having non-compacted consistency, resilient softness, and an irregular fibrous feel and appearance as produced by being dried in a free space without finish-forming pressure, the protruding egg holding and protecting portions being formed and arranged to provide cushioning areas within each egg pocket to support an egg of the size which the carton is dimensioned to accommodate.

2. A molded pulp egg carton as in claim 1 wherein the egg holding and protecting portions of the inner surface of the pocketed bottom take the shape of elongated cushioning ribbons arranged in generally vertically radial array within each egg pocket as produced by generally vertically radial slots providing free spaces in a drying and pressing mold.

3. A molded pulp egg carton as in claim 2 wherein the egg pockets have effectively horizontal bottoms, and the egg holding and protecting portions further include circular cushioning ribbons protruding upwardly from the bottom of each pocket as produced by circular slots providing free spaces in a drying and pressing mold.

4. A molded pulp egg carton as in claim 3 wherein the cushioning ribbons have a width of at least about ⅛ inch, and protrude from the thinner wall portions at least about 1/32 inch at their thickest part.

5. A molded pulp egg carton as in claim 4 wherein the cushioning ribbons occupy less than 50% of the inner surface of the pocketed bottom.

6. A molded pulp egg carton as in claim 1 wherein the inner surface of the closeable cover has a finely textured embossed feel and appearance as produced by being finish-formed with a pressing surface defined by a fine-mesh heated screen.

7. A molded pulp egg carton as in claim 1 wherein the outer surface of the pocketed bottom has a generally smooth feel and appearance as produced by being finish-formed with a smoothly polished, heated metal pressing surface.

8. A molded pulp egg carton as in claim 1 wherein a locking flap is integrally hinged to the pocketed bottom for folding between a closed position for locking cooperation with the closed cover and an open position which permits a like empty carton to be nested therein in a stack of such cartons, the outer surface of the locking flap having a generally smooth feel and appearance as produced by being finish-formed with a smoothly polished, heated metal pressing surface.

9. A molded pulp egg carton as in claim 1 wherein the pocketed bottom is formed to provide a plurality of egg pockets arranged in two parallel rows, and the closeable cover in the closed position overlies both rows of egg pockets.

10. A molded pulp egg carton as in claim 1 wherein the closeable cover includes a flat planar base, and surrounding side walls with a vertical depth no greater than one-half the length of an egg of the size which the carton is dimensioned to accommodate.

* * * * *